United States Patent [19]

Weirich et al.

[11] 4,327,628

[45] May 4, 1982

[54] HYDRAULIC ROOF SUPPORT CONTROL SYSTEM

[75] Inventors: Walter Weirich, Dortmund; Michael Dettmers, Kamen, both of Fed. Rep. of Germany

[73] Assignee: Gewerkschaft Eisenhutte Westialia, Fed. Rep. of Germany

[21] Appl. No.: 162,546

[22] Filed: Jun. 24, 1980

Related U.S. Application Data

[63] Continuation of Ser. No. 869,014, Jan. 10, 1978, abandoned.

[30] Foreign Application Priority Data

Jan. 11, 1977 [DE] Fed. Rep. of Germany ..... 2700829

[51] Int. Cl.[3] ..... F15B 11/16

[52] U.S. Cl. ..... 91/522; 91/527; 91/529; 91/530; 405/302

[58] Field of Search ..... 91/170 MP, 427, 453, 91/461, 521, 527, 531, 522, 528, 529, 530; 405/302; 137/596.14, 596.18

[56] References Cited

U.S. PATENT DOCUMENTS

| | | | |
|---|---|---|---|
| 3,589,241 | 6/1971 | Bolton | 91/527 |
| 3,805,674 | 4/1974 | Sebesta | 91/461 |
| 3,889,481 | 6/1975 | Weirich | 405/302 |
| 3,906,738 | 9/1975 | Weirich | 91/453 |
| 3,958,493 | 5/1976 | Fujita | 92/62 |
| 4,072,011 | 2/1978 | Ewald | 60/555 |
| 4,114,376 | 9/1978 | Cattaneo | 60/548 |
| 4,159,671 | 7/1979 | Allen | 91/461 |

FOREIGN PATENT DOCUMENTS

| | | | |
|---|---|---|---|
| 1114006 | 5/1968 | United Kingdom | 91/170 MP |
| 1261110 | 1/1972 | United Kingdom | 91/530 |

*Primary Examiner*—Abraham Hershkovitz
*Attorney, Agent, or Firm*—Neil F. Markva

[57] ABSTRACT

A hydraulic control system is provided for a mine roof support assembly constituted by a plurality of roof support units positioned side-by-side. The control system comprises a respective control valve assembly having a plurality of similar control valves each of which controls a respective hydraulic appliance associated with the corresponding roof support unit. Each control valve can be actuated optionally by an actuator mounted on either one of the two adjacent roof support units, or by either one of two actuating devices mounted one on each of said two adjacent roof support units. Each control valve includes two servo valves having a pair of first and second axially aligned servo-pistons which are separate and independently operable with respect to each other.

23 Claims, 4 Drawing Figures

HYDRAULIC ROOF SUPPORT CONTROL SYSTEM

This is a continuation, of application Ser. No. 869,014, filed Jan. 10, 1978 now abandoned.

BACKGROUND TO THE INVENTION

This invention relates to a control system for a hydraulic roof support assembly of an underground mining installation.

A known type of hydraulic roof support assembly is constituted by a plurality of identical roof support units positioned side-by-side along, for example, a longwall face. A known control system for such an assembly has a control valve assembly associated with each roof support unit. Each valve assembly consists of a set of similar pilot-operated (servo) control valves connected to a common hydraulic power supply line and to the rams operating that roof support unit. The control system is further provided with means for actuating the servo control valves from a remote point whereby automatic control of all units is achieved, and with means for effecting control of each unit from an adjacent roof support unit. In the latter case an operator can control a roof support unit while protected by the adjacent unit from which that control is being effected. This is known as proximity control.

In a known type of proximity control system, commands are emitted by an actuator on one roof support unit along a hydraulic control line to the control valve assembly of an adjacent roof support unit. The valves of this assembly are then pressurized by the hydraulic medium and actuate the associated hydraulic rams of that roof support unit. The actuator for controlling any given roof support unit is always mounted on the adjacent roof support unit up slope and in a position convenient for handling. The actuators are constituted by lever-actuated rotary slide valves.

A roof support control of this type is known in which the rotary slide valves (actuators) are each provided with an additional switching position, in which the sequence of mining operations comprising coal-cutting, advance and support setting of the roof support units is performed automatically without manual actuation of the actuators. In this case, the face workers may operate the roof support units either by manual adjustment of the actuators or cause the whole advance to be performed automatically. Manual or automatic operation may be switched on and off at any stage of the cycle. In this case, each of the control valves is provided with two separate control circuits for two servopistons mounted in parallel, one piston serving for manual control and the other for automatic control of the associated unit.

Another roof support control system is known having a manually actuated control valve and an automatic control valve actuated by remote signals. The two control valves are separated by a two-way valve so that the two control valves may be operated quite independently of one another. This type of roof support control system is suitable both for direct control of a roof support unit based on the principle of proximity control from an adjacent roof support unit as well as for performing automatically sequenced operation of the roof control units by remote control.

The aim of the invention is to provide a roof support control system of the proximity type which is relatively cheap and simple and in which, without basic changes to the roof support assembly, every roof support unit can be actuated selectively from either the righthand or lefthand adjacent roof support unit.

SUMMARY OF THE INVENTION

The present invention provides a hydraulic control system for a mine roof support assembly constituted by a plurality of roof support units positioned side-by-side. The control system comprises a respective control valve assembly associated with each of the roof support units. Each control valve assembly includes a plurality of control valves each of which controls a respective hydraulic appliance associated with the corresponding roof support unit, each control valve assembly being connected to actuating means. Each control valve assembly includes a servopiston for controlling that valve in dependence upon control signals from the associated actuating means.

Advantageously, each control valve is included two servo valves each of which controls said respective hydraulic appliance. Each of the servo valves has a respective servopiston for controlling that servo valve in dependence upon control signals from the associated actuating means. In practice, the hydraulic appliances being controlled are double-acting hydraulic rams, so that one servo valve of a given control acts to control the expansion of the associated ram (or group of rams) and the other servo valve of that control valve controls the retraction of that ram (or group of rams).

The two servo valves of each control valve may be arranged in a parallel, side-by-side relationship.

Advantageously, the two servo valves of each control valve are manually actuable by means of a common member, and preferably, a respective cam lever pivotally mounted on the control valve constitutes said common member of each control valve.

Proximity control from one side is preferably achieved by the actuating means associated with any given control valve assembly being constituted by an actuator which, in use, is mounted on an adjacent roof support unit. By connecting the actuator to its control valve assembly by a hose of sufficient length, the actuator can be positioned optionally on either the lefthand or the righthand adjacent roof support unit.

Where proximity control is additionally required from both sides, the actuating means associated with any given control valve assembly may be additionally constituted by a pair of actuating devices each of which is, in use, mounted on one of the two adjacent roof support units.

It is also possible to have proximity control from both sides without utilizing the actuator which can be optionally positioned on either adjacent roof support unit. In this case, the actuating means associated with any given control valve assembly is constituted by a pair of actuating devices each of which is, in use, mounted on one of the two adjacent roof support units. In practice, either the actuator positioned optionally on either adjacent roof support unit, or the actuating devices positioned on both adjacent units will be used. In each case, however, the control valve assembly associated therewith will be the same and so a relatively simple control system results.

The actuator may be constituted by a plurality of switching valves, a respective switching valve being associated with each of the corresponding control valves. Advantageously, the switching valves of each actuator are grouped together within a common actuator housing, and each switching valve is actuated by means of a lever. Preferably, each switching valve is constituted by a pair of slide valves arranged in a parallel, side-by-side relationship. The two slide valves of each switching valve may be actuated by a rocker lever which constitutes said lever. Advantageously, each slide valve controls a respective servopiston of the two servovalves of the corresponding control valve.

Each actuating device may be constituted by a rotary slide valve assembly. Advantageously, each rotary slide valve assembly is arranged to actuate selectively either of the control valve assemblies of the two adjacent roof support units. Preferably, each rotary slide valve assembly is provided with a manually operable selector arm for selecting which of said control valve assemblies is actuated.

In order that the control valve assemblies can optionally be actuated by the actuators or the actuating devices, the two servo valves of each control valve may be provided with a pair of axially-aligned servopistons. A first servopiston of each pair controls the associated servo valve in dependence upon control signals from the associated actuator, and the second servopiston of each pair controls said servo valve in dependence upon control signals from either of the associated actuating devices. In other words, the first and second servopistons are separate and operate independently with respect to each other. In this case, it is advantageous if each pair of servopistons are axially aligned in the same bore in the respective control valve housing as the corresponding servo valve.

Preferably, each pair of servopistons is provided with a respective pressure-balancing piston which is coaxial therewith and whose working stroke lies in the same direction as those of that pair of servopistons.

BRIEF DESCRIPTION OF THE DRAWINGS

The invention will now be described in greater detail, by way of example, with reference to the accompanying drawings, in which.

DESCRIPTION OF PREFERRED EMBODIMENT

Figure 1:
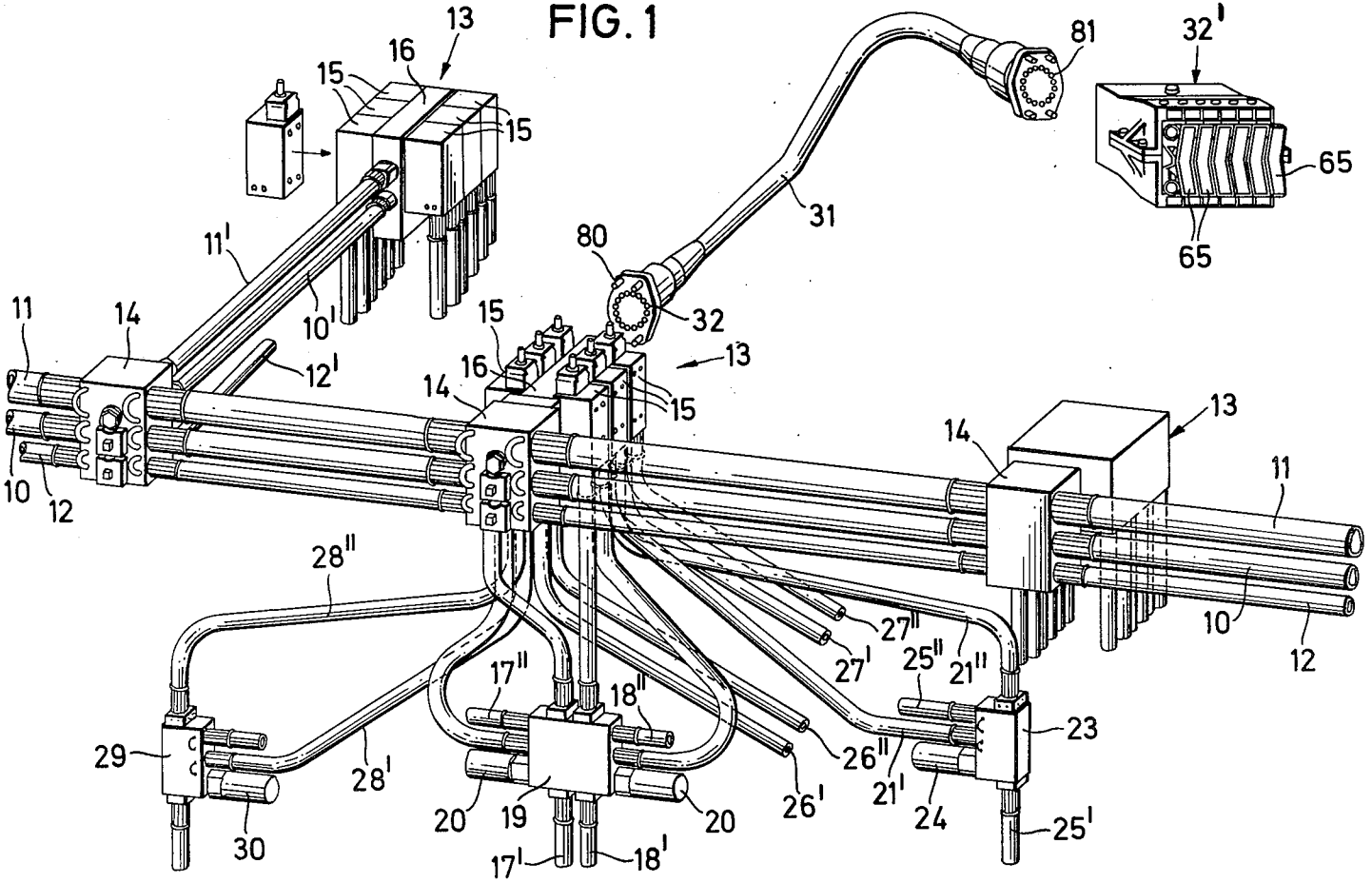
FIG. 1 is a diagrammatic perspective view of part of a control system for controlling a roof support unit by means of an actuator provided on either of the adjacent roof support units.

Referring to the drawings, FIG. 1 shows a hydraulic high pressure line 10, a return line 11 and a low pressure line 12 which are laid along the entire length of a longwall mine working. Each of the roof support units (not shown) is connected to these lines 10, 11 and 12. Each roof support unit may consist of a floor sill, a roof shield and a goaf shield supported on the floor sill by means of hydraulic props. Each roof support unit is provided with a control valve assembly 13 connected by a manifold 14 to the common longwall lines 10, 11 and 12. The control valve assemblies 13 may be positioned directly on the manifolds 14 (as seen at the center of FIG. 1), or they may (as seen at the left of FIG. 1) be connected to the manifolds by extension hoses 10', 11' and 12'. In the latter case, the control valve assemblies 13 may be mounted on the longwall conveyor.

In the embodiment of FIG. 1, the control valve assemblies 13 each have six servo control valves 15 arranged in parallel along both sides of distributor plate 16 and fixed thereto by, for example bolts. The distributor plate 16 is itself connected to the manifold 14 either directly or by means of the extension hoses 10', 11' and 12'. The control valves 15 are used to actuate the various hydraulic rams of the associated roof support unit. Thus, for the central valve assembly 13 shown in FIG. 1, are indicated the hydraulic lines connecting the individual control valves 15 to the various rams of the associated roof support unit. It is assumed here that the roof support unit has four hydraulic props in rectangular arrangement, both front props and both rear props being retracted and extended in unison. Both front props of the roof support unit are actuated hydraulically in the direction of extension from hydraulic line 17' and retracted via line 17''. The rear props are correspondingly extended via a line 18' and retracted via a line 18''. These hydraulic supply lines are connected by a servo actuated double check valve 19 provided with a pressure-relief valve 20 to the appropriate control valves 15. The advance ram (or rams) of the associated roof support unit is connected with the appropriate control valve 15 by lines 21' and 21''. The lines 21' and 21'' are connected to a servo-actuated check valve 23 which is provided with a pressure-relief valve 24. The lines leading to the opposite cylinder spaces of the advance ram (s) are denoted by 25' and 25''.

When the roof support unit is provided with one or more hydraulic setting rams these may be operated from hydraulic lines 26' and 26''. Similarly, lines 27' and 27'' supply hydraulic pressure to a ram which controls the position of a roof shield extension provided to cover the gap between the main roof shields of two adjacent roof support units. Where each roof support unit is provided with a roof shield extension directed towards the longwall face, the hydraulic ram which controls this extension may be supplied from lines 28' and 28''. Here again, the lines 28' and 28'' are connected to a servo-actuated check valve 29 provided with a pressure-relief valve 30.

It is clear from the above that the control valve assembly for each roof support unit comprises six control valves 15 each of which controls a ram or rams associated with that unit. The valves 15 are actuated via a multi-core hose 31 by means of an actuator 32' which can be mounted on either one of the two adjacent roof support units. The control hose 31 has here sixteen control cores 32, two cores being connected via the control valve assembly 13 and the manifold 14 with the high pressure line 10 and two cores being connected to return line 11. The remaining twelve cores serve to actuate the control valves 15, two cores being associated with each control valve 15.

Figure 3:
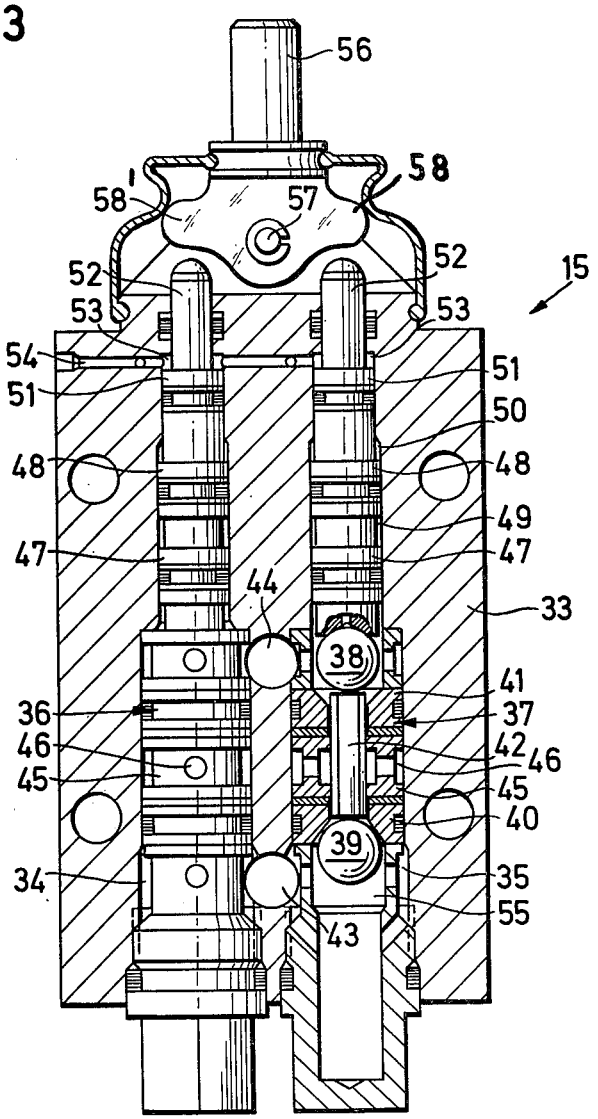
FIG. 3 is a sectional view of a control valve for use with the control system of FIGS. 1 and 2.

Each control valve 15 (see FIG. 3) has a generally cuboidal body 33 provided with two stepped, parallel bores 34 and 35 which accommodate servovalves 36 and 37 respectively. Both the servovalves 36 and 37 are of the same design and each is provided with two ball valves 38 and 39 functioning as non-return valves by co-operating with matching valve seats 40 and 41. A spindle 42 extends between the ball valves 38 and 39. A bore 43 provided in the body 33 is connected via the distribution plate 16 of the valve assembly 13, to the high pressure line 10 and a second bore 44 is connected to the return line 11. Each bore 34 and 35 is provided with an insert 45 between the corresponding seats 40 and 41. Each insert 45 has a radial groove 46 connected with an axial groove which accommodates the spindle 42, this axial groove being itself connected with a control channel (not shown) in the valve body 33. The control channel of one of the servovalves 36 and 37, leads to one cylinder space of the ram (or rams) being controlled by the control 15 in question, and the control channel of the other servovalve leads to the other cylinder space of that ram.

To effect hydraulically remote control of the servovalves 36 and 37 of a given control valve 15 from an adjacent roof support unit, the bores 34 and 35 in the body 33 of that valve 15 are each provided with a pair of servopistons 47 and 48 which are coaxially arranged in tandem and rest against one other. Annular cylinder spaces are provided for controlling the servopistons 47 and 48, these being denoted 49 and 50. The spaces 49 or the spaces 50 are connected by separate channels in the valve body 33 with the associated pair of control cores 32 in the hose 31. A pressure-balancing valve piston 51 is mounted in each of the bores 34 and 35 beyond the corresponding pair of servopistons 47 and 48. Each piston 51 is provided with a spindle 52 which extends through a bore in the end face of the valve body 33. An annular cylinder space 53 is formed in each balancing piston 51 and the two spaces 53 are connected by a channel 54 and matching channels in the distributor plate 16 and manifold 14 with the low pressure line 12 or extension hose 12''. The balancing pistons 51 are also acted upon by the high pressure medium passing through the bore 43 and prevailing in the cylinder spaces 55 at the opposite ends of the servovalves 36 and 37. As this pressure acts in a direction opposite to the other pressures prevailing in each of the servovalves 36 and 37, the servovalves are largely pressure balanced.

In order that the control valve 15 can be manually operated a cam lever 56 is pivotally mounted on an articulated pin 57 at the top end of valve body 33. When swung clockwise, the lever 56 operates the servovalve 37 by means of a cam 58 which acts on the spindle 52 of the corresponding balancing piston 51. This force acts downwards via the servopistons 47 and 48 to actuate the servovalve 37. When swung anti-clockwise, the lever 56 operates the servovalve 36 by means of the cam 58'. The control valves 15 can therefore be actuated manually by swinging the hand lever 56 in the required direction. Due to the pressure balancing referred to above, the required switching forces are low. As shown and as is evident in FIG. 3, ball valve 39 is in a normally closed position on seat 40. The pressure applied to either of the servopistons 36 and 37 causes the spindle 42 to lift the corresponding ball valve 39 from its seat 40 to an open position. With ball valve 39 in the open position, channel 46 is thereby connected with the corresponding operating space of cylinder to the high pressure line 10 via the channel 43. At the same time the ball valve 38 is kept on its seat 41 and so blocks connection to the return line 11 via the bore 44 in the body 33. Pressure is then admitted into the corresponding cylinder space controlled by the servovalve 36 or 37 which has been manually actuated, whereas the opposite cylinder space of the same ram is connected to the return line 11 via the other servovalve. The same applies analogically when the control valve 15 serves to control not one but a set of rams.

Figure 4:
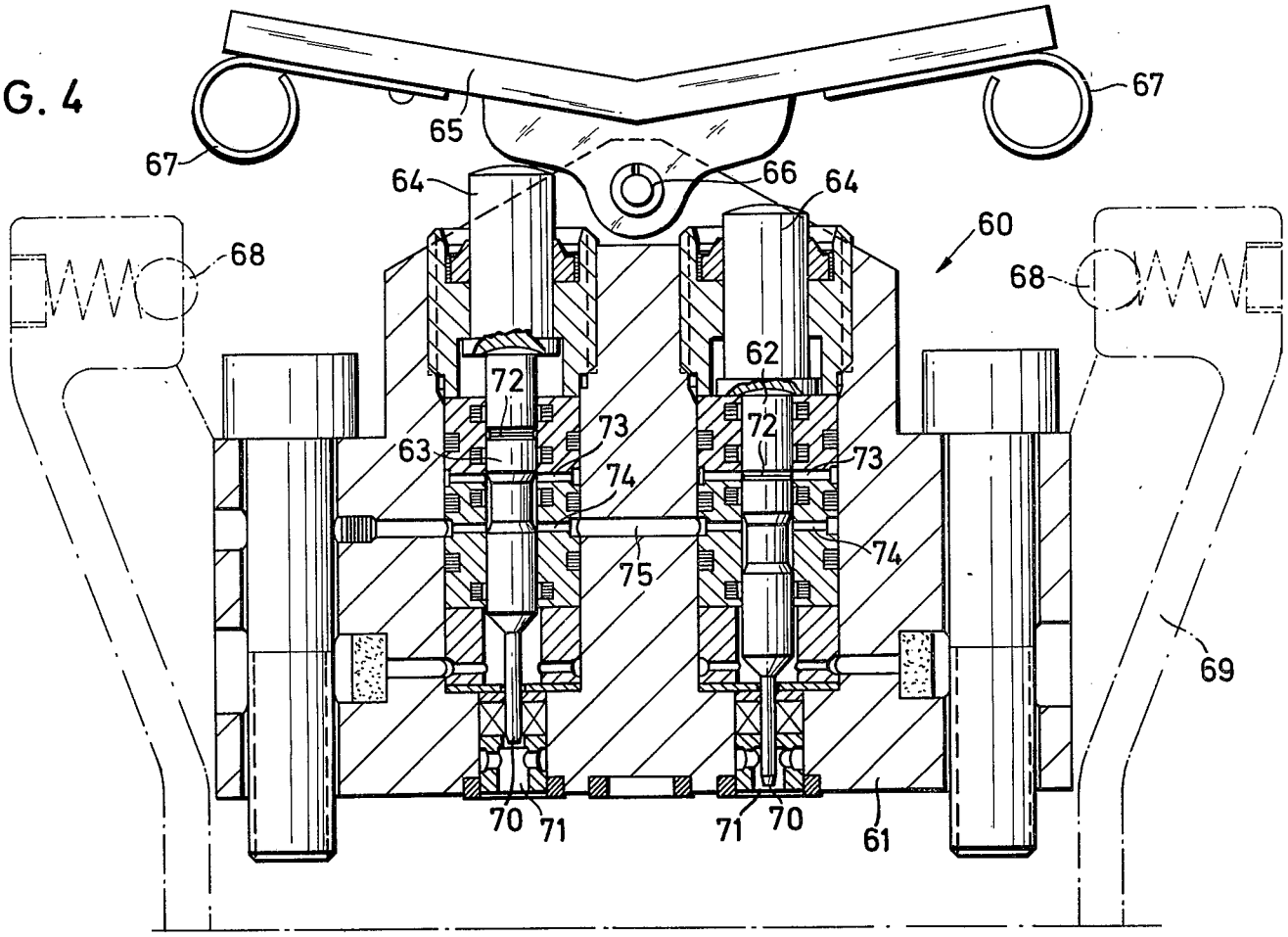
FIG. 4 is a cross-section through an actuator of the control system of FIG. 1.

Proximity control is effected via an actuator 32' provided with a set of switching valves 60 each of which is operated by a lever 65. All the stitching valves 60 are accommodated in a common assembly and FIG. 4 shows a single switching valve. The valve 60 has a body 61 in the form of a flat metal plate and provided with a pair of parallel stepped bores for two 4/3 way valves 62 and 63. These valves 62 and 63 are slide valves and are each operated by a respective spindle 64 from a common lever 65 pivotally mounted by a pin 66 on the body 61. A slotted circlip 67 is provided at each end of the lever 65 on its underneath, each circlip interacting with a respective spring loaded catch ball 68 mounted on an arm 69. The lever 65 is easily released from either arrested position. The arms 69 also hold together the six valves 60.

Both the slide valves 62 and 63 of each valve 60 are provided with axial channels (not shown) which extend to the needle-shaped ends 70 of the slide valves and enter bores 71. The bores 71 are connected by one core 32 of the hose 31 to the high-pressure line 10. The axial channels terminate, at their other ends, in radial channels 72. The spools in the bores of the valves 62 and 63 have radial passages 73 and 74. Each passage 73 is connected with a respective central core 32 of the hose 31, and the passages 74 are inter-connected via a channel 75 in the body 61 and via a core 32 in the hose 31, with the return line 11. Both slide valves 62 and 63 can be operated manually by the lever 65 so that the control core 32 associated with one slide valve (say 62) is connected with the high pressure line 10, whereas the control core 32 associated with the other valve (say 63) is connected to the return line 11. When the lever 65 is actuated, the corresponding control valve 15 is actuated by applying pressure via the appropriate control core 32, to the relevant servopiston 47 or 48 (say the relevant servopiston 47). Each working ram or set of rams may, therefore, be actuated (either to extend or retract) by the switching valve 60 and its swing lever 65.

The hose 31 is provided at its two ends with couplings 80 and 81 of the plug-and-socket type. The hose 31 is connected with the corresponding distributor plate 16 by means of the coupling 80 and with the actuator 32' by means of the coupling 81. The hose 31 has such a length that the actuator 32' may be mounted either on the righthand or the lefthand adjacent roof support unit, so that proximity control can be effected from either side.

The roof support control system described above may be easily adapted for two-way proximity control without need to modify the valve assemblies 13. In this case, instead of hoses 31 and actuators 32', special actuators 80' (see FIG. 2) are used. Each actuator 80' consists of a plurality of rotary slide valves operated by a hand lever 81'. Each actuator 80' may be connected to its control valve assembly 13 either directly or by extension hoses. Moreover, the actuators 80' of adjacent roof support units are interconnected by multicore hydraulic hoses 82. Each actuator 80' has sixteen switching positions, twelve positions serving for actuating six functions (namely six switching positions for actuating six functions on the adjacent lefthand roof support unit and six positions for actuating six functions on the adjacent righthand roof support unit). The remaining four switching positions are intended for additional functions. Thus, the entire arrangement is such that every actuator 80' actuates the control valve assembly 13 of either the righthand or lefthand adjacent roof support unit. During actuation, the corresponding cores of the hose 82 supply pressure to the relevant servopistons 47 or 48 of the appropriate control valve 15. If the actuators 32' of the FIG. 1 embodiment actuate their control valves 15 by means of the servopistons 47, then the actuators 80' of this embodiment will actuate the control valves by means of the servopistons 48, and vice-versa. Thus, proximity control can be effected from either or both adjacent roof support units without modifying the control valves 15. Thus, it is evident that servopistons 47 and 48 are separate and are independently operable with respect to each other.

Figure 2:
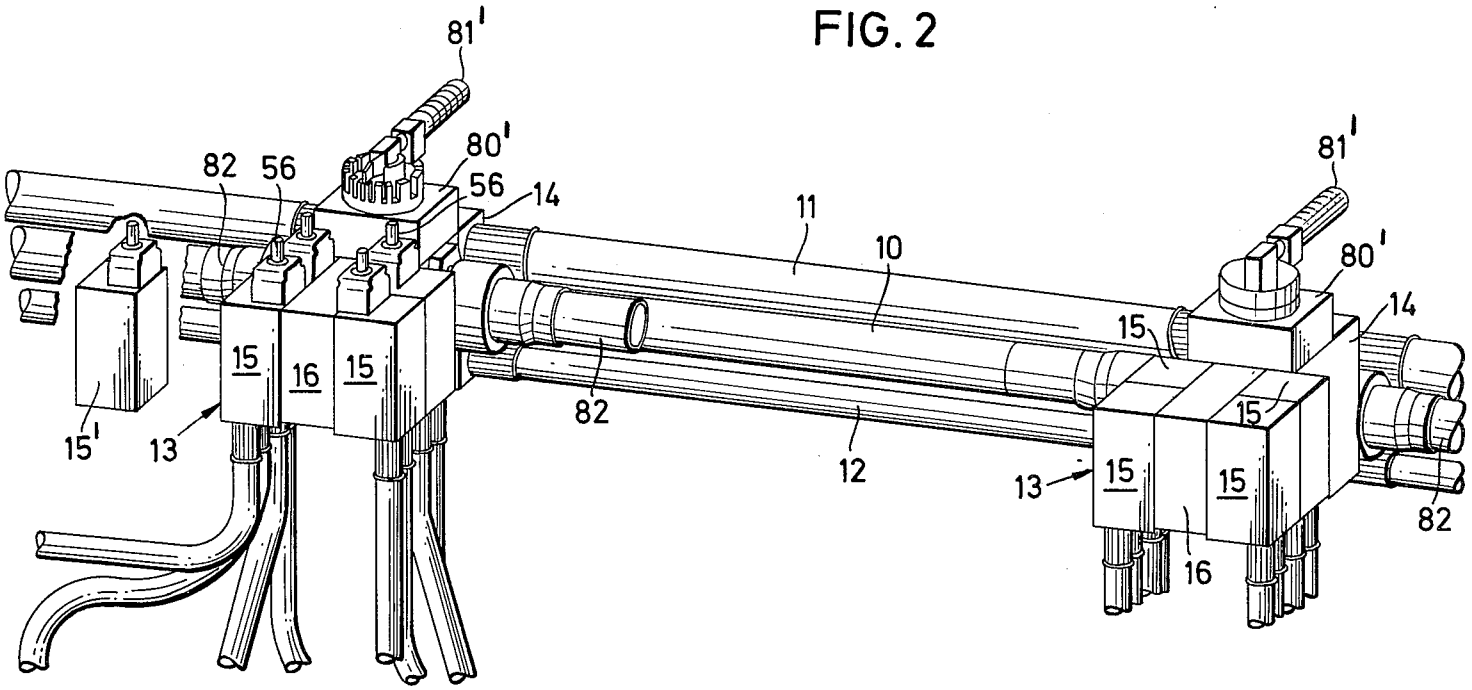
FIG. 2 is a view similar to that of FIG. 1 in which each roof support unit can be controlled from both of the adjacent roof support units.

In the embodiment of FIG. 2 only four control valves 15 are provided in each control valve assembly 13. As shown at the lefthand part of this figure, the control valve assembly 13 may be provided with additional control valves 15' in case additional operating rams for roof shield control are to be installed in the units. As with the embodiment of FIG. 1, the control valves 15 may be controlled either hydraulically or manually by cam levers 56, manual control being needed chiefly for emergency operation. The control valves 15 are all identical 4/3 way valves with three switching positions that is to say "extension", "retraction" or "neutral" in which they may be maintained by springs. In the "neutral" position, the valves 15 connect the pressure input lines 10 and 12 with the return line 11.

The multicore hose 82, together with the supply hoses 10, 11 and 12, is laid along the entire length of the longwall working. Normally, the cores of the hose 82 are supplied with hydraulic pressure from the high pressure line 10 but if needed they can be supplied from the low pressure line 12 instead. The main purpose of the low pressure line 12 is to advance the longwall conveyor (not shown) by pressurising the appropriate cylinder spaces in the conveyor advance rams. The low pressure line 12 also supplies pressure to the balancing pistons 51 (see FIG. 3) of the control valves 15.

All the control valves 15 are of cuboidal modular construction for ease of assembly to the distributor plates 16, to form units which have varying numbers of valves depending upon the number of rams to be controlled. Moreover, the hoses 32 and 82 are provided with plug-in connectors ensuring quick and reliable connection. A particular advantage of this control system is that hydraulic control is effected with the pressure medium from the high pressure line 10. This greatly simplifies hydraulic roof support control and the control lines and the control valves can then have relatively small sizes.

Where automatic control, forms a remote position, of all the roof support units is required, this can be effected by actuation of a respective one of the servopistons 47 and 48 of each of the servovalves 36 and 37 of each control valve 15. In this case, some modification to the control system is necessary. For example, where automatic control is effected magnetically, each of the servopistons 47 or 48 will be provided with a controlling electromagnetic valve all of which will be controlled via a common electric control cable. It would also be possible to control the servopistons 47 or 48 hydraulically.

It is evident from the drawings and as described herein that the movable servopistons 47 and 48 are each effective to open the associated servo valve 37 in dependence upon control signals from an associated actuator. That is, each time either of the servopistons 47 or 48 move toward the servo valve 37, ball valve 38 and spindle 42 are actuated to move ball valve 39 from its normally closed-position on seat 40 to an open position.

While the hydraulic roof support control system has been shown and desribed in detail, it is obvious that this invention is not to be considered as being limited to the exact form disclosed, and that changes in detail and construction may be made therein within the scope of the invention, without departing from the spirit thereof.

We claim:

1. A hydraulic control system for a mine roof support assembly constituted by a plurality of roof support units positioned side-by-side, the control system comprising:

(a) a respective control valve assembly associated with each of the roof support units, (b) each control valve assembly including a plurality of control valves each of which controls a respective hydraulic appliance associated with the corresponding roof support unit, (c) each control valve including two servo valves each of which controls said respective hydraulic appliance, (d) each of the servo valves including a pair of first and second axially-aligned servopistons which are separate and independently operable with respect to each other, the first servopistons of each control valve assembly defining a first set of servopistons, and the second servopistons of each control valve assembly defining a second set of servopistons, (e) each servopiston of each pair of said first and second axially-aligned servopistons being separately and independently effective to open the associated servo valve, (f) a respective actuating device mounted in the region at each roof support unit, the actuating devices being connected to the control valve assemblies of adjacent roof support units by multi-core hoses, (g) each of the actuating devices being effective to initiate control signals which are sent, via the associated multi-core hose, to one of said first and second sets of servopistons of the control valve assembly of an adjacent roof support unit, said one set of servopistons being effective to open the associated servo valves, and (h) a respective manual control device mounted on each control valve and effective to open directly the servo valves of that control valve.

2. A hydraulic control system according to claim 1, wherein each associated servo valve includes a ball valve disposed in a normally closed position on a valve seat, said ball valve being movable from said valve seat to an open position by movement of either of said axially aligned servopistons.

3. A hydraulic control system according to claim 1, wherein the two servo valves of each control valve are disposed in a parallel, side-by-side relationship.

4. A hydraulic control system according to claim 1, wherein said manual control means includes a common member to manually actuate the two servo valves of each control valve.

5. A hydraulic control system according to claim 4, wherein said common member includes a respective cam lever pivotally mounted on the control valve.

6. A hydraulic control system according to claim 1, wherein
each actuating device includes a first actuator,
each first actuator being connected to the associated first set of servopistons by a hose of sufficient length to permit the first actuator to be mounted optionally on either adjacent roof support unit.

7. A hydraulic control system according to claim 6, wherein
each first actuator is constituted by a plurality of switching valves, a respective switching valve being associated with each of the corresponding control valves.

8. A hydraulic control system according to claim 7, wherein
the switching valves of each said first actuator are grouped together within a common actuator housing.

9. A hydraulic control system according to claim 7, wherein
each switching valve is actuated by a lever.

10. A hydraulic control system according to claim 9, wherein
each switching valve includes a pair of slide valves arranged in a parallel, side-by-side relationship.

11. A hydraulic control system according to claim 10, wherein
said lever is a rocker lever, and
the two slide valves of each switching valve are actuated by the rocker lever.

12. A hydraulic control system according to claim 11, wherein
each slide valve controls a respective first servopiston of the two servo valves of the corresponding control valve.

13. A hydraulic control system according to claim 1, wherein
each actuating device includes a pair of second actuators,
each second actuator being connected to the associated second set of servopistons, and
the second actuators of each actuating device being mounted one on each of the two adjacent roof support units.

14. A hydraulic control system according to claim 13, wherein
each second actuator comprises a rotary slide valve assembly.

15. A hydraulic control system according to claim 14, wherein
each rotary slide valve assembly is effective to selectively actuate the second set of servopistons of either of the control valve assemblies of the two adjacent roof support units.

16. A hydraulic control system according to claim 15, wherein
each rotary slide valve assembly includes a manually operable selector arm for selecting which of said control valve assemblies is actuated.

17. A hydraulic control system according to claim 1, wherein
each pair of servopistons is disposed in the same bore in the respective control valve housing as the corresponding servo valve.

18. A hydraulic control system according to claim 1, wherein
each pair of servopistons includes a respective pressure-balancing piston which is coaxial therewith and whose working stroke lies in the same direction as those of that pair of servopistons.

19. A hydraulic control system according to claim 18, wherein further comprising a high-pressure supply line, a low-pressure supply line and a return line, all of which are connected to all of the control valve assemblies and
hydraulic fluid from the low-pressure line is supplied to the pressure balancing pistons.

20. A hydraulic control system according to claim 1, further comprising
a high-pressure supply line, a low-pressure supply line and a return line, all of which are connected to all of the control valve assemblies.

21. A hydraulic control system according to claim 20, wherein
hydraulic fluid from the high-pressure line is used to actuate the control valves.

22. A hydraulic control system for a mine roof support assembly constituted by a plurality of roof support units positioned side-by-side, the control system comprising:
(a) a respective control valve assembly associated with each of the roof support units,
(b) each control valve assembly including a plurality of control valves each of which controls a respective hydraulic appliance associated with the corresponding roof support units,
(c) each control valve including two servo valves each of which controls said respective hydraulic appliance,
(d) each of the servo valves including a pair of first and second axially-aligned servopistons which are separate and independently operable with respect to each other,
(e) each servopiston of each pair of said first and second axially-aligned servopistons being separately and independently effective to open the associated servo valve,
(f) a respective first actuator associated with each of the roof support units, each said first actuator being mounted in the region of a roof support unit adjacent to said associated roof support unit and being connected to the control valve assembly thereof by a multi-core hose,
(g) a respective second actuator connected to the control valve assembly of each of the roof support units, the second actuators being interconnected by lengths of multi-core hose,
(h) the first servopistons of a given control valve assembly being effective to open the associated servo valves in dependence upon control signals from the associated first actuator, thereby permitting proximity control of said control valve assembly from one side,
(i) the second servopistons of a given control valve assembly being effective to open the associated servo valves in dependence upon control signals from the second actuator associated with either of the adjacent roof support units, thereby permitting proximity control of said control valve assembly from both sides, and
(j) a respective manual control device mounted on each control valve and effective to open directly the servo valves of that control valve, the manual control devices permitting local control of the control valves.

23. A hydraulic control system according to claim 22, wherein
each associated servo valve includes a ball valve disposed in a normally closed position on a valve seat,
said ball valve being movable from said valve seat to an open position by movement of either of said axially aligned servopistons.

* * * * *